United States Patent [19]

Kuhlmann et al.

[11] Patent Number: 4,507,353

[45] Date of Patent: Mar. 26, 1985

[54] METAL RING FABRIC FOR PROTECTIVE CLOTHING

[75] Inventors: Gerhard Kuhlmann; Gerhard Schleihauf; Emil Brandauer, all of Mühlacker, Fed. Rep. of Germany

[73] Assignee: Friefrich Munch GmbH & Co. KG., Mühlacker, Fed. Rep. of Germany

[21] Appl. No.: 573,482

[22] Filed: Jan. 24, 1984

[30] Foreign Application Priority Data

Feb. 19, 1983 [DE] Fed. Rep. of Germany ..... 3305841

[51] Int. Cl.[3] ..... D03D 13/00

[52] U.S. Cl. ..... 428/222; 264/258; 264/271.1; 264/279.1; 428/256; 428/294; 428/447; 428/457

[58] Field of Search ..... 428/64, 67, 222, 371, 428/447, 457, 294, 256; 264/258, 271.1, 279, 279.1

[56] References Cited

U.S. PATENT DOCUMENTS

| | | | |
|---|---|---|---|
| 3,449,199 | 6/1969 | Mead | 428/222 |
| 3,700,012 | 10/1972 | Alderfer | 428/222 |
| 4,421,818 | 12/1983 | Leonard | 428/221 |

FOREIGN PATENT DOCUMENTS

| | | | |
|---|---|---|---|
| 689413 | 9/1930 | France | 428/222 |

*Primary Examiner*—James J. Bell

*Attorney, Agent, or Firm*—Balogh, Osann, Kramer, Dvorak, Genova & Traub

[57] ABSTRACT

A metal ring fabric for protective clothing is stiffened by the provision of stiffening strips, which consist of flexible, particularly elastomeric or thermoplastic material and in which strip-shaped portions of the metal ring fabric are embedded.

24 Claims, 3 Drawing Figures

Figure 1:
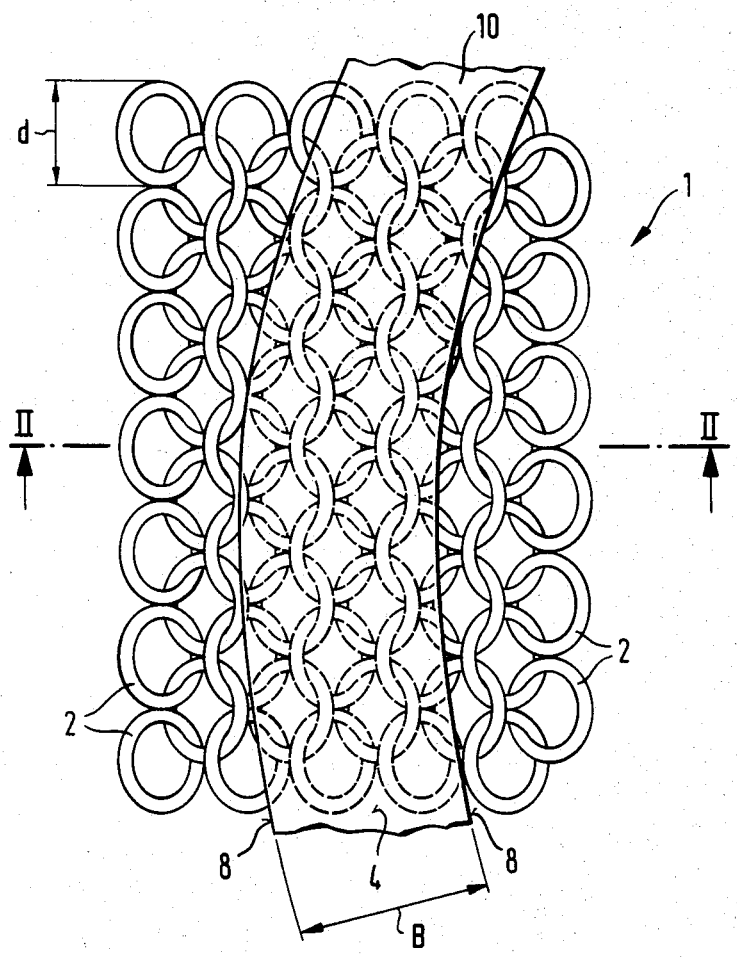

Fig. 2
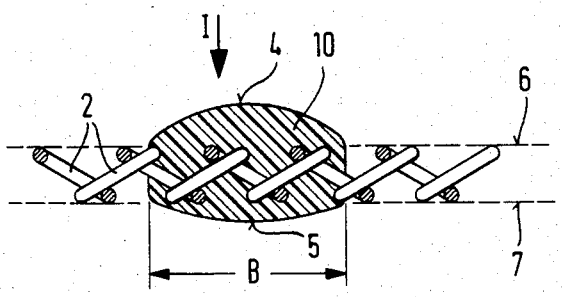
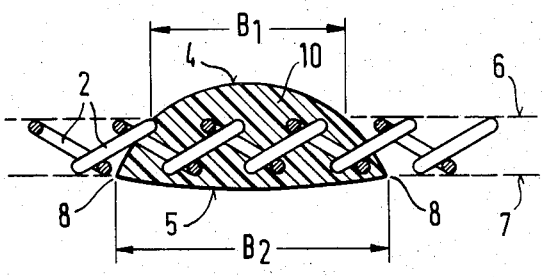
Fig. 3

METAL RING FABRIC FOR PROTECTIVE CLOTHING

This invention provides an improved metal ring fabric for protective clothing.

Protective clothing made of metal ring fabrics are worn by persons who handle tools or other articles or work at machines which involve a high risk of injury, particularly cuts, of the person, mainly at his or her extremities. Such persons are, e.g., butchers, glass industry workers handling sharp-edged glass panes, metal-working industry workers handling sheet metal plates, or cardbox-making industry workers who work at cutting or punching machines. The examples mentioned above illustrate only some of the fields in which such protective clothing can be used. Metal ring fabrics have proved satisfactory for such purposes because they afford adequate protection from injury and are so flexible that they readily hug the body of the wearer and do not obstruct his movements. A metal ring fabric is a metal fabric consisting of metal rings which are interlaced so as to be freely movable relative to each other.

But the high flexibility of metal ring fabrics involves also disadvantages, which will now be explained by reference to a protective glove, which is provided with an extended cuff for protecting the forearm. If such cuff consists of a metal ring fabric, it will collapse and be packed adjacent to the wrist unless the cuff extends behind the elbow and is held there by a strap which surrounds the arm. But such strap will adversely affect the freedom of movement of the arm.

It is known from Laid-open German Application 28 25 525 that that disadvantage can be avoided in that a glove which consists of a metal ring fabric extending only as far as to the wrist is provided with a stiff plastic cuff, which has a high dimensional stability. But such cuff has the disadvantage that it does not protect the forearm as effectively as a metal ring fabric and that the cuff does not readily hug the forearm and for this reason will obstruct numerous activities of the wearer.

It is an object of the invention so to improve a metal ring fabric for protective clothing that the fabric combines high stiffness and high dimensional stability with adequate flexibility.

This object is accomplished in that strip-shaped areas of the metal ring fabric are embedded in stiffening strips of flexible material.

By the strips of flexible material, the metal ring fabric is stiffened in the longitudinal direction of such strips so that the metal ring fabric can no longer be packed together in the longitudinal direction of said strips but is still flexible so that it can hug that portion of the body which is to be protected, even during movements of said body portion. Those portions of the metal ring fabric which are not covered by the stiffening strips retain their original flexibility and ensure that the stiffened metal ring fabric will readily hug the adjacent portion of the body. In dependence on the intended purpose the metal ring fabric may be provided with stiffening strips which cross each other or with strips which do not cross each other. A metal ring fabric provided with crossing stiffening strips which cross each other will be stiffened in two directions and cannot be packed freely in either direction. Such fabric will be particularly suitable for a protection of parts of the trunk of the body, e.g. of the chest. A metal ring fabric provided with stiffening strips which do not cross each other can easily be packed in a direction which is transverse to the stiffening strips and is highly flexible in that direction like an uncovered metal ring fabric. Such fabric will be particularly suitable for the protection of an arm or leg. In that case the stiffening strips should extend substantially along the arm or leg so that the fabric cannot be packed along the arm or leg in a downward direction even when the fabric is not fixed to the arm or leg by special means. The degree to which the fabric is stiffened may be selected within wide limits in dependence on the intended purpose by a selection of the spacing, width and thickness of the stiffening strips and of the stiffness of the material used to form the stiffening strips. The stiffening strips and those portions of the metal ring fabric which are embedded in the stiffening strips form composite portions, which promote the stiffening and ensure that the stiffened fabric is stiffer in the longitudinal direction of the stiffening strips than the stiffening strips would be without the embedded metal ring fabric. For this reason the stiffening strips may consist of rather soft material; this will promote the flexibility of the stiffened metal ring fabric.

In order to ensure a durable, intimate bond between the metal ring fabric and the stiffening strips, the metal ring fabric is preferably embedded in the stiffening strips continuously and throughout the length of said strips and the material of the stiffening strips preferably covers the outside and inside surfaces of the protective clothing formed by the metal ring fabric and extends through the same so that metal rings forming a series extending in the longitudinal direction of the stiffening strips are entirely embedded in the flexible material.

For this reason each stiffening strip should be wider than the largest ring diameter of the fabric embedded therein and the distance between adjacent stiffening strips which do not cross each other should be at least twice the ring diameter in order to ensure that the stiffened metal ring fabric has an adequate flexibility.

The stiffening strips should be made from a material in which the metal ring fabric can be embedded and which is highly flexible but still has a stiffening action. Examples of suitable materials are thermoplastic materials, such as soft polyvinylchloride, low-pressure polyethylene or soft polyamides. Stiffening strips consisting of a thermoplastic material may be made, e.g. by injection molding with polymerization in situ. For this purpose a portion of an uncovered metal ring fabric is placed between the two sections of a cavity-defining two-part mold and a predetermined quantity of the material or of its precursors, such as monomeric substances from which the material is formed in the mold cavity by polymerization, is injected in a fluid state under pressure into the mold cavity. Because the metal ring fabric has been placed into the mold, the latter cannot be entirely closed so that part of the injected material can emerge on the sides of the mold and the stiffening strips will have an irregular contour. This will not adversely affect the essential properties of the stiffening strips. The two sections of the mold can be removed as soon as the thermoplastic material has sufficiently solidified (hardened) to ensure that the molded shape of the stiffening strips will be retained. Measures by which the hardening of thermoplastic materials can be accelerated are known in the art and may be adopted here in case of need.

In another process of providing a metal ring fabric with stiffening strips of thermoplastic material each stiffening strip may be formed from two thermoplastic strips, which are disposed on opposite sides of the metal ring fabric and lie one over the other. These two strips can then be joined by welding through the metal ring fabric by the action of heat and pressure to form a stiffening strip in which a strip-shaped area of the metal ring fabric is embedded.

Elastomeric plastic materials, particularly silicone elastomers, can be used to special advantage in the process involving a polymerization in situ and will ensure that the stiffened fabric will be highly flexible and highly durable.

At least on the outside surface of the protective clothing made from the metal ring fabric, the stiffening strips should be substantially convex so that they appreciably protrude from the surface of the metal ring fabric. This feature will promote the reliable anchoring of the stiffening strips in the fabric and will improve the wear resistance of the stiffening strips. The anchoring of the stiffening strips in the metal ring fabric can be further improved and a cushioning effect can be achieved if the stiffening strips are substantially convex also on the inside surface of the protective clothing which consists of the metal ring fabric although the convexity of the stiffening strips on the inside surface of the clothing is desirably smaller than the convexity on the outside surface. The expression "substantially convex" is intended to indicate that each stiffening strip should protrude mainly at the center of its width whereas the edge portions of the strips desirably slope into the metal ring fabric gently rather than at a steep angle in order to minimize the surface which is exposed at the edges of the strip and may be rubbed to remove the material of the stiffening strip from the metal ring fabric. In that connection it will be particularly desirable to provide stiffening strips which cover a larger area on the inside surface of the protective clothing consisting of the metal ring fabric than on the outside surface of such clothing because in that case the edge of the stiffening strip, i.e., that portion of the strip where the rubbing of the strip from the fabric may begin, will be disposed inside the fabric or on the inside surface of the clothing and will thus be protected.

Illustrative embodiments of the stiffened metal ring fabric according to the invention are shown on the accompanying drawings, in which:

FIG. 1 is a top plan view showing a portion of a metal ring fabric and a strip of flexible and particularly elastomeric material anchored in said fabric, FIG. 2 is a sectional view taken on line II—II in FIG. 2 and FIG. 3 is a sectional view like that of FIG. 2 and shows a stiffening strip having a different cross-sectional shape.

Identical or corresponding items are designated with the same reference characters in the different views.

In all examples shown on the drawings, the metal ring fabric 1 consists of identical circular rings 2. In the interior of the fabric, each ring 2 is interlaced with four adjacent rings. Each ring will obviously be interlaced with fewer rings at the edge of the fabric and at seams provided to adapt the shape of the fabric to the contour of a portion of the body.

A stiffening strip 10 of elastomeric material, particularly plastic material, is anchored in the portion of the metal ring fabric 1 shown in FIG. 1. The stiffening strip 10 is slightly curved; this shape may be desirable to facilitate the adaptation to a portion of the body or to movements of extremities. It will be understood that stiffening strips having different shapes and particularly straight-line stiffening strips, which may cross each other, may be anchored in the metal ring fabric 1. The outside surface 4 of the stiffening strip 10 covers a portion of that surface 6 of the metal ring fabric which will constitute the outside surface of the clothing formed from said fabric. The inside surface 5 of the stiffening strip 10 has a smaller curvature than its outside surface 4 and covers a corresponding portion of that surface 7 of the fabric which will constitute the inside surface of the protective clothing. The width B of the stiffening strip 10 is about twice the outside diameter d of a ring.

The stiffening strip 10 shown in FIG. 3 consists also of elastomeric material, particularly plastic material, but differs from the stiffening strip of FIG. 2 in that its width $B_1$ measured on the level of the outside surface 6 of the fabric, i.e., in the upper tangential plane indicated by a dotted line on the drawing, is smaller than the width $B_2$ measured on the level of the inside surface 7 of the fabric, i.e., in the lower tangential plane indicated by a dotted line, and both widths exceed the outside diameter d of a ring 2. In this arrangement the side edge 8 of the stiffening strip 10 is not disposed on the outside of the fabric 1 but inside the latter close to its inside surface and is thus protected from being rubbed off. Besides, the outside surface 4 of the stiffening strip 10 has a higher convexity than its inside surface.

The edges 8 of the stiffening strip 10 are schematically shown in the drawings and in most cases will be irregular in practice.

In the drawings, only a portion of a metal ring fabric and a single stiffening strip are shown. A plurality of stiffening strips having the illustrated cross-sectional shapes may be provided in a fabric and may be spaced apart or cross each other.

What is claimed is:

1. In a metal ring fabric for protective clothing, the improvement residing in the provision of stiffening strips, which consist of flexible material and cover only part of the area of said metal ring fabric and in which strip-shaped portions of the metal ring fabric are embedded.

2. The improvement set forth in claim 1, wherein said metal ring fabric is embedded in each of said stiffening strips in a continuous area extending throughout the length of said stiffening strip.

3. The improvement set forth in claim 1, wherein said flexible material is thermoplastic.

4. The improvement set forth in claim 1, wherein said flexible material is an elastomer.

5. The improvement set forth in claim 1, wherein said flexible material is a silicone elastomer.

6. The improvement set forth in claim 1, wherein said stiffening strips cover said strip-shaped portions of said fabric on opposite sides thereof.

7. The improvement set forth in claim 6, wherein each of said stiffening strips is wider on one side of said fabric than on the other.

8. The improvement set forth in claim 6, wherein said stiffening strips have convex portions protruding on both sides of said fabric.

9. The improvement set forth in claim 8, wherein said convex portions have a stronger curvature on one side of said fabric than on the other.

10. The improvement set forth in claim 1, wherein said stiffening strips cover said strip-shaped portions on one side of said fabric and said stiffening strips have convex portions protruding on said one side of said fabric.

11. The improvement set forth in claim 1, wherein each of said embedded strip-shaped portions consists of rings having a given outside diameter and each of said stiffening strips has a width in excess of said outside diameter.

12. The improvement set forth in claim 1, wherein each of said embedded strip-shaped portions consists of rings having a given outside diameter, and said stiffening strips comprise adjacent strips which do not cross each other and are spaced apart by at least twice said outside diameter.

13. The improvement set forth in claim 1, wherein said stiffening strips are substantially parallel to each other.

14. The improvement set forth in claim 1, wherein said stiffening strips comprise strips crossing each other.

15. In protective clothing comprising a metal ring fabric, the improvement residing in the provision of stiffening strips, which consist of flexible material and cover only part of the area of said metal ring fabric and in which strip-shaped portions of the metal ring fabric are embedded.

16. The improvement set forth in claim 15 are applied to protective clothing in which said metal ring fabric covers at least part of an arm, wherein said stiffening strips extend generally in the longitudinal direction of said arm.

17. The improvement set forth in claim 15 as applied to protective clothing in which said metal ring fabric covers part of a leg, wherein said stiffening strips extend generally in the longitudinal direction of said leg.

18. The improvement set forth in claim 15 as applied to protective clothing in which said metal ring fabric constitutes an outside surface and an inside surface of said clothing, wherein said stiffening strips have convex portions protruding on the outside and inside surfaces of said clothing and said convex portions have a stronger curvature on the outside surface of said clothing than on the inside surface thereof.

19. The improvement set forth in claim 15 as applied to protective clothing in which said metal ring fabric constitutes an outside surface and an inside surface of said clothing, wherein said stiffening strips cover said strip-shaped portions of said fabric on opposite sides thereof and each of said stiffening strips is wider on the outside surface of said clothing than on the inside surface thereof.

20. In a process of manufacturing a stiffened metal ring fabric, the improvement residing in that strip-shaped portions of said metal ring fabric are embedded in respective stiffening strips which consist of flexible material and which cover only part of the area of said metal ring fabric.

21. The improvement set forth in claim 20, wherein a two-part mold having first and second mold sections which define at least one elongated mold cavity is provided, the first and second mold sections are brought together, at least one strip-shaped portion of said metal ring fabric is placed into said mold to extend in said at least one mold cavity, a predetermined quantity of a fluid material adapted to form said flexible material of said stiffening strips is injected under pressure into said at least one mold cavity and is permitted to solidify in said at least one mold cavity, and said two mold sections are separated from each other when said fluid material has solidified.

22. The improvement set forth in claim 21, wherein said fluid material is a precursor of said flexible material and said two mold sections are separated from each other when said flexible material has been formed from said precursor and has solidified.

23. The improvement set forth in claim 20, wherein strip-shaped portions of said metal ring fabric are placed between pairs of thermoplastic strips which cover each other and cover only part of the area of said metal ring fabric and the strips of each of said pairs are joined by being welded through said metal ring fabric.

24. The improvement set forth in claim 20, wherein said strip-shaped portions of said metal ring fabric are embedded in said stiffening strips after said metal ring fabric has been processed to form protective clothing.

* * * * *